US011191377B2

(12) United States Patent
Jensen et al.

(10) Patent No.: US 11,191,377 B2
(45) Date of Patent: Dec. 7, 2021

(54) GYROSCOPICALLY STABILIZED DRINKWARE

(71) Applicant: WiSys Technology Foundation, Inc., Madison, WI (US)

(72) Inventors: Adam David Jensen, Green Bay, WI (US); Rosalyn Ottilia Stoa, Green Bay, WI (US); Katherine Grace Mikhail, Green Bay, WI (US)

(73) Assignee: WISYS TECHNOLOGY FOUNDATION, INC., Madison, WI (US)

( * ) Notice: Subject to any disclaimer, the term of this patent is extended or adjusted under 35 U.S.C. 154(b) by 228 days.

(21) Appl. No.: 16/523,130

(22) Filed: Jul. 26, 2019

(65) Prior Publication Data

US 2020/0029710 A1 Jan. 30, 2020

Related U.S. Application Data

(60) Provisional application No. 62/703,614, filed on Jul. 26, 2018.

(51) Int. Cl.
*A47G 19/22* (2006.01)

(52) U.S. Cl.
CPC .... *A47G 19/2266* (2013.01); *A47G 2200/046* (2013.01); *A47G 2400/08* (2013.01)

(58) Field of Classification Search
CPC ..... A47G 19/2266; A47G 19/2288; A47G 19/2227; A47G 2200/046; A47G 2400/08; A47J 41/0044; A61B 5/1101; A61F 4/00; G05B 2219/37134
USPC ..... 220/710.5; 224/926; 33/522; 73/1.77, 73/503.3
See application file for complete search history.

(56) References Cited

U.S. PATENT DOCUMENTS

| | | | | |
|---|---|---|---|---|
| 2,183,312 | A * | 12/1939 | Goddard | F02K 9/605 74/5 R |
| 5,058,571 | A * | 10/1991 | Hall | A63B 21/222 601/87 |
| 7,450,783 | B2 | 11/2008 | Talapov et al. | |
| 9,445,078 | B2 | 9/2016 | Sneyders et al. | |
| 9,615,683 | B2 | 4/2017 | Peacock | |
| 2009/0078714 | A1 | 3/2009 | Peacock | |
| 2015/0031510 | A1* | 1/2015 | Ben-Haim | A63B 21/00181 482/110 |
| 2017/0100272 | A1* | 4/2017 | Pathak | A61J 7/00 |

* cited by examiner

*Primary Examiner* — King M Chu
(74) *Attorney, Agent, or Firm* — Boyle Fredrickson, S.C.

(57) ABSTRACT

A cup for use with those having muscular tremors provides a battery-operated gyroscope stabilizing the cup body as supported by a handle communicating with the cup body through one or more pivot joints. The cup body may also be weighted to be naturally stabilized in a vertical orientation.

14 Claims, 3 Drawing Sheets

GYROSCOPICALLY STABILIZED DRINKWARE

CROSS REFERENCE TO RELATED APPLICATION

This application claims the benefit of U.S. provisional application 67/703,614 filed Jul. 26, 2018 and hereby incorporated by reference.

STATEMENT REGARDING FEDERALLY SPONSORED RESEARCH OR DEVELOPMENT

Background of the Invention

The present invention relates generally to drinkware and in particular to a cup that can compensate for minor muscular tremors in individuals holding the cup and drinking from the cup.

Muscular tremors are associated with neurological conditions, including multiple sclerosis and stroke, and can produce involuntary shaking in an individual's hand that makes it difficult for the individual to manage everyday tasks such as eating and drinking. Compensation strategies for drinking include using a straw or travel cup, but these can be inadequate to the extent that they presuppose some stability between the cup and the individual's mouth which may not be present.

Sophisticated utensils have been developed to assist those having muscular tremors, for example, from Liftware available from Verily Life Sciences LLC, an Alphabet company, for example, providing for stabilized handles for spoons. The stabilization systems employ servo motors and sensitive motion sensors communicating with a computer which controls the servomotors to counteract detected motion. Such systems are relatively expensive and because of limitations in servo response time are limited to tremors having a frequency of less than 4 Hertz.

SUMMARY OF THE INVENTION

The present invention provides a gyroscopically stabilized cup attached to a pivoted handle that may be held by an individual with muscular tremors. The gyroscope provides direct stabilization without the need for feedback loops and is relatively inexpensive making this design more accessible to a greater number of individuals. The gyroscope is combined with lowered placement of the center of gravity of the cup volume and a handle design which directs tremors along a controlled axis, providing for improved stability. The gyroscopic stability is not frequency limited in the manner of a servo mechanism and can compensate for high-frequency tremors.

More specifically, in one embodiment, the invention provides a stabilized cup for individuals with muscular tremors having a cup body providing a bottom wall and peripheral sidewalls extending upwardly from the bottom wall to an open rim to define a cup volume for receiving liquids through the rim along a cup body axis and holding those liquids when the cup body axis is in an upright orientation. An electrically powered gyroscope rotor is rotatably attached to the cup body to provide gyroscopic stabilization of the cup body.

It is thus a feature of at least one embodiment of the invention to provide a drinking cup that can provide improved stability against muscular tremors affecting the user's hand without the need for complex servo mechanisms and the like.

The electrically powered gyroscope may be mounted to the cup body below the cup volume and the stabilized cup may further include a battery communicating with the electrically powered gyroscope rotor for providing power for rotation of the electrically powered gyroscope rotor and wherein the battery is mounted to the cup body below the cup volume.

It is thus a feature of at least one embodiment of the invention to opportunistically place the weight of the gyroscope and battery in a manner that improve stability and properly orient the cup prior to and after activation of the gyroscope.

The cup may include a handle adapted to be grasped by the hand of a user of the stabilized cup while using the stabilized cup, and a pivoting joint may connect the cup body to the handle to allow pivoting of the handle with respect to the cup body about at least a first axis angled to the cup body axis.

It is thus a feature of at least one embodiment of the invention to isolate hand tremors from the cup through a pivoting joint.

A center of mass of the cup body may be positioned below the first axis when the cup body is filled with liquid.

It is thus a feature of at least one embodiment of the invention to enlist gravity in orienting the cup both before and during gyroscopic stabilization.

The pivoting joint may pivot about a substantially horizontal axis when the cup axis is vertical.

It is thus a feature of at least one embodiment of the invention to preferentially allow corrections for motion that would tend to spill the cup by tipping it.

The electrically powered gyroscope may be mounted to rotate about an axis substantially parallel to the cup body axis.

It is thus a feature of at least one embodiment of the invention to permit the gyroscope to stabilize against tipping about multiple axes that would tip the cup body axis from vertical and thereby promote spillage.

The handle may provide a vertical portion to be grasped by the hand of the user so that a proximal/distal axis of the forearm of the hand aligns with the at least one first axis.

It is thus a feature of at least one embodiment of the invention to provide for compensation against tremors along a major axis of the arm.

The stabilized cup may further include a lid sealingly fitting over the rim and providing an orifice displaced toward a front of the cup away from the vertical cup axis and at least one first axis along a direction perpendicular to both the cup vertical axis and at least one first axis.

It is thus a feature of at least one embodiment of the invention to promote contact between the user's lips and the cup at a location that can further stabilize the cup while being isolated from tremors by the axis of a single pivoting joint.

The pivoting joint may pivot about at least two axes and may slide along at least one axis.

It is thus a feature of at least one embodiment of the invention to accommodate various types of tremors along different axes.

The stabilized cup may further include an electrical switch controlling power between the battery and the electrically powered gyroscope rotor. The electrical switch may provide an operator exposed at the handle for actuation by a user while grasping the handle.

It is thus a feature of at least one embodiment of the invention to allow the gyroscopic action to be controlled by the user during use, for example, to disable the gyroscope while drinking or when the cup is set on the table to conserve battery power.

These particular objects and advantages may apply to only some embodiments falling within the claims and thus do not define the scope of the invention.

DETAILED DESCRIPTION OF THE PREFERRED EMBODIMENT

Figure 1:
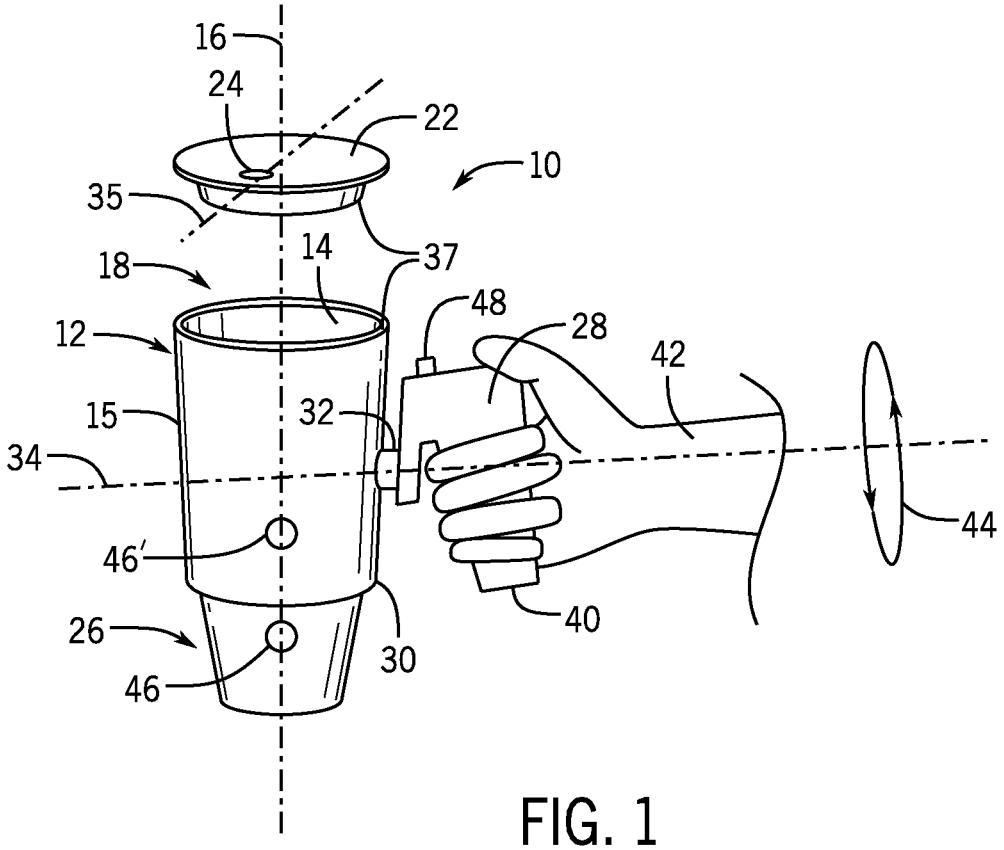
FIG. 1 perspective view of the cup design of the present invention showing various axes and showing, in phantom, a pivot joint between the cup handle and cup.

Referring now to FIG. 1, a gyroscopically stabilized cup 10 of the present invention may provide for a main cup body 12 having inner walls 14 extending around a perimeter of a lower circular base wall (not shown). The inner walls 14 extend upwardly about a vertical cup axis 16 to define an inner volume 18 opening upwardly at a circular rim 20. The inner volume 18 may receive liquids through the circular rim 20 in the manner of a standard cup and may, for example, hold 1 to 2 cups of liquid. In one embodiment, the main cup body 12 may be constructed of a thermoplastic material providing good thermal insulation and simple fabrication.

The inner walls 14 may be surrounded by concentric outer walls 15 spaced from the inner walls, for example, by an insulating space or the like.

The rim 20 may accept a removable lid 22 fitting tightly to seal against rim 20 closing the inner volume 18. The removable lid 22 has a small opening 24 therein for receiving a straw or for drinking directly therefrom. The opening 24 is sized to reduce spill in the manner of a conventional travel cup.

The inner walls 14 will be constructed of a food safe material and may in some embodiments be removable from the main cup body 12 for separate washing independent of the remainder of the gyroscopically stabilized cup 10. For example the inner walls 14 may snap or thread into corresponding connectors in the main cup of body 12. Alternatively the inner walls 14 may be a disposable material such as a paper cup that may be received within the main cup body 12. In this way, the other mechanisms of the gyroscopically stabilized cup 10 may be protected from excessive temperatures and contact with water for example as might occur in dishwasher washing.

A handle 28 may be attached to an outer sidewall 30 of the main cup body 12 by means of a joint 32 allowing the handle 28 to pivot about a horizontal pivot axis 34 perpendicular to and intersecting the vertical axis 16. The joint 32, for example, may provide for an outer sleeve having a sliding central axle or the like as is generally understood in the art and may, for example, include lubricated sliding bearing surfaces or ball bearings or the like. The joint 32 may include spring biasing (not shown) to return the joint to a neutral position and/or mechanical stops that limit the angular rotation of the handle 28 with respect to the cup body 12, for example, to 180° about vertical. It will be appreciated that the joint 32 need not be a sliding or rotating joint but that a similar effect can be obtained from flexible members such as springs or the like. The joint 32 may be stabilized by elastic damping elements as well.

The handle 28 may extend upward along the outer walls 15 from the joint 32 and then connect with a downwardly extending grip portion 40 promoting a grasping of the handle 28 with a proximal/distal axis of the user's forearm 42 generally aligned with pivot axes 34. In this way, the user's forearm 42 may be positioned with respect to the axis 34 so that an important mode of tremor-induced rotation 44 may be aligned with the pivot axis 34 to be fully compensated by pivoting about the pivot axis 34.

The removable lid 22 may be keyed to the rim 20 by interfitting key elements 37 so that the opening 24 in the removable lid 22 it is displaced from the vertical cup axis 16 forwardly along an axis 35 generally perpendicular to both the vertical cup axis 16 and the pivot axis 34. In this way, the user's lips positioned in contact with the opening 24 may stabilize the cup and be isolated from twisting motion of the user's forearm 42 by the pivot joint 32.

An upper edge of the handle 28 may provide for a switch operator 48 of an electrical switch allowing a stabilization feature of the cup to be activated by a user's thumb when the user is holding the handle 28.

A stabilizer unit 26 is attached to the bottom of the main cup body 12 to extend downward therefrom aligned with the axis 16 as discussed in more detail below.

The cup 10 is weighted so as to provide for a center of gravity 46 below the main cup body 12 when the cup 10 is empty and a center of gravity 46' below the pivot axis 34 and the attachment of the handle 28 when the cup 10 is filled with a liquid having a density approximating that of water. In this way, gravity provides for a first mode of stabilization of the cup 10 against tremors about pivot axis 34 by acting on the center of gravity 46 or 46' to pivot cup body 12 to a vertical orientation. In addition, the effective mass at the center of gravity 46' or 46 may be such as to provide a weight of at least eight ounces to provide for inertial stabilization.

Figure 2:
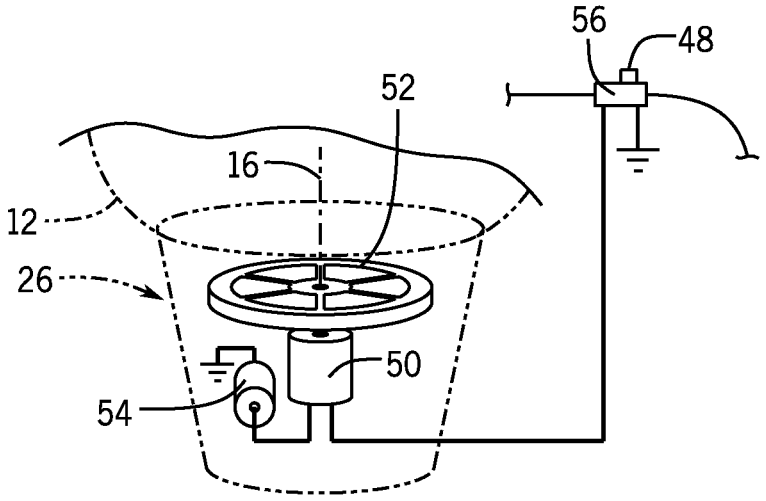
FIG. 2 is a phantom view of a base assembly of the cup holding a gyroscope controllable by a handle-mounted switch.

Referring now to FIG. 2, the stabilizer unit 26 may provide for a DC electric motor 50 having a rotatable shaft communicating with a flywheel 52 for rotating the flywheel 52 about the axis 16 to provide a gyroscopic stabilization. The flywheel 52, for example, may be a dense metallic material or the like to increase its rotational inertia for a given speed and size. The motor 50 may be driven by one or more batteries 54 which are also held in the stabilizer unit 26 to provide for a lower center of gravity 46. The batteries 54 may be attached electrically to an electrical switch 56 associated with the operator 48 communicating between the batteries 54 and the motor 50 to control the flow of electrical power therebetween.

During use the user may activate the operator 48 to control the switch 56 which may be a slide switch or a momentary pushbutton switch that is normally open. When the switch 56 is closed, power is provided to the motor 50 to begin rotation of the flywheel 52 providing the gyroscopic stabilization stabilizing the cup 10 in its attitude at the time of the pressing of the switch 56. Importantly, this attitude need not be precisely vertical allowing the cup 10 to be stabilized in variety of convenient angles or orientations depending on the time of pressing of the operator 48. The switch 56 also allows the gyroscopic stabilization to be deactivated, for example, if it is desired to tip the cup for drinking. It will be appreciated that the switch 56 may likewise be activated automatically when the cup 10 is raised by sensing the weight of the cup on the handle 28.

Figure 3:
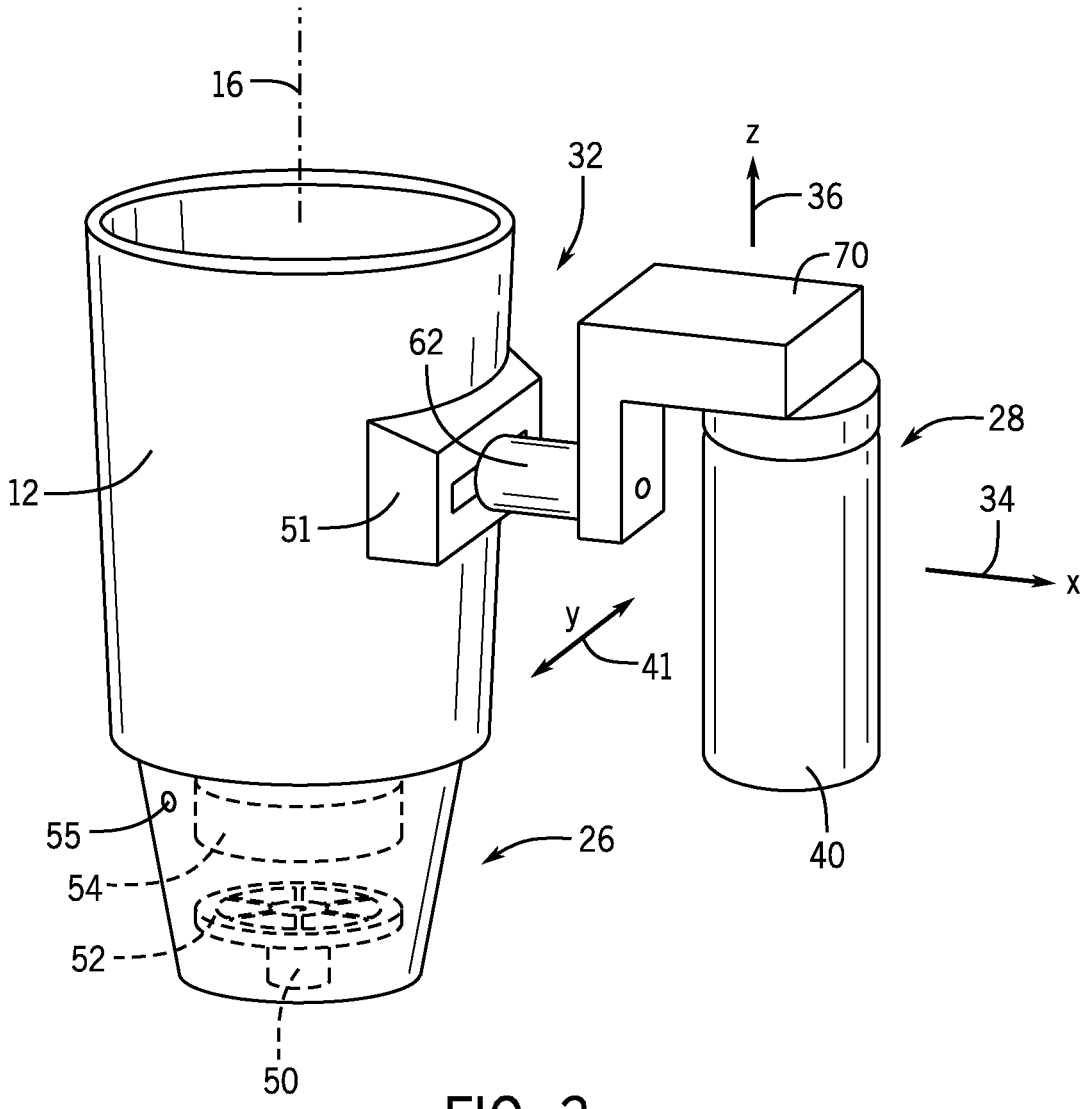
FIG. 3 is a view similar to that of FIG. 1 showing a multi-axis joint between the cup handle and the cup for improved isolation of tremors.
Figure 4:
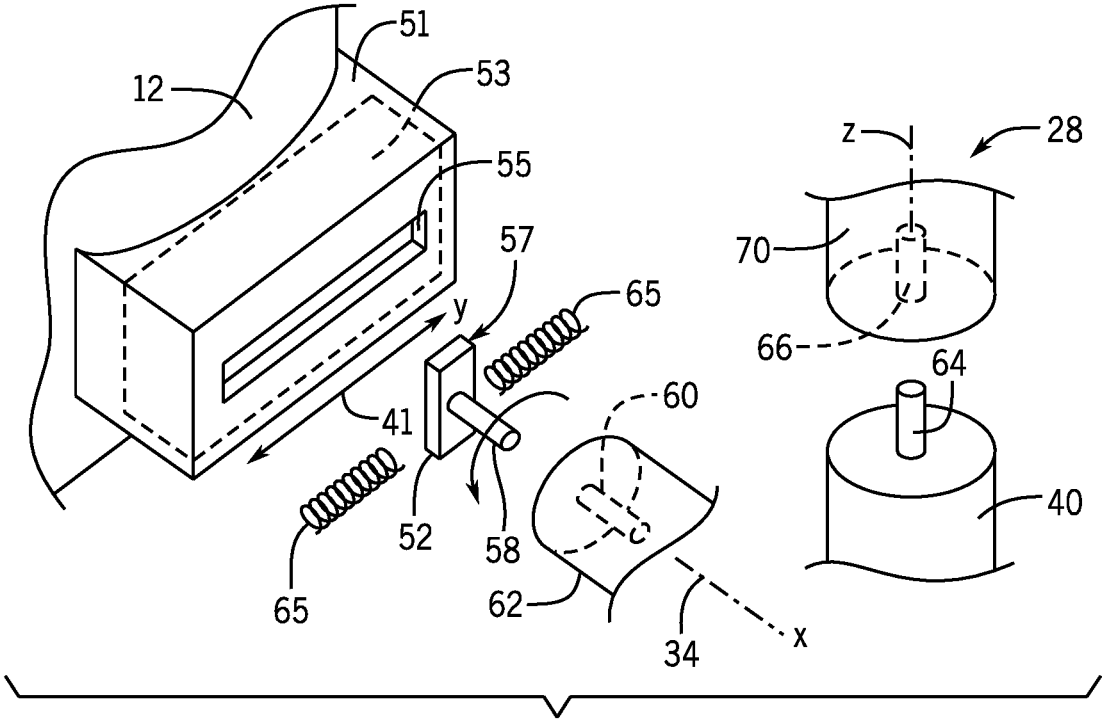
FIG. 4 is a detailed exploded view in partial fragment of the multiaxis joint of FIG. 3.

Referring now to FIG. 3, in an alternative embodiment, the joint 32 may provide for pivoting not only about axis 34 (designated the X-axis) but also about perpendicular vertical axis 36 (designated as the Z-axis) as well as sliding along axis 41 (designated the Y-axis) perpendicular both to axis 34 and axis 36. Referring also to FIG. 4, in this embodiment, the cup body 12 may attach to a collar 51 having an internal slide cavity 53 opening through a narrow slot 55 parallel to axis 41. A T-slide 57 may have a T-portion 59 fitting within the cavity 53 and held captive therein to slide along the axis 41 and may have a pin portion 58 passing outward through the slot 55 to be rotatably received by a cylindrical journal 60 in a handle attachment stub 62. In this way, the handle stub 62 (and hence the handle 28 to which it is attached) may rotate with respect to the cup body 12 about axis 34 and may slide along axis 41 with respect to the cup body 12. Helical compression springs 64 may fit within the cavity 53 on either side of the T-portion 59 to provide a centering bias of the T-portion 59 within the cavity 53.

The downwardly extending grip portion 40 of the handle 28 may likewise have an axle pin 64 extending vertically upward and pivotally fitting in a corresponding downwardly open cylindrical journal 66 in a handle extension 70 joining the stub 62 to the downwardly extending grip portion 40. In this way the downwardly extending grip portion 40 may rotate about the axis 36 with respect to the cup body 12.

Referring still to FIG. 3, the weight of the batteries 54 may be centered along the cup axis 16 to be aligned with the rotational axis of the gyroscope for improved balance. In one embodiment, the stabilizer unit 26 may be threadably removable from the cup body 12 for easy access to the batteries 54 and the gyroscope unit of motor 50 and flywheel 52. In this regard, it will be appreciated that the batteries 54 may be either replaceable or permanently installed and accessible for recharging through a recharging port 55 as shown. The invention gyroscopic cup contemplates that other methods of removably attaching the stabilizer unit 26 to the cup body 12 may be employed including for example magnets or bayonet type mount or other similar mounting techniques.

Figure 5:
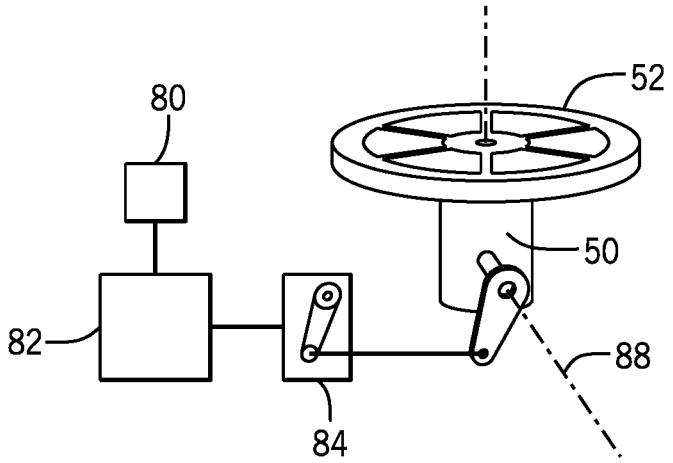
FIG. 5 is a simplified representation of a servo system for moving the gyroscope to actively counteract tremor forces.

Referring now to FIG. 5, in one embodiment active sensing of motion of the cup body 12 is contemplated, for example, using one or both of an accelerometer and gyroscope sensor 80 communicating with a microcontroller 82 powered by the batteries 54 (for example, shown in FIG. 2) to control a servo motor 84. The servo motor may tip the gyroscope, comprised of the flywheel 52 and motor 50, along arbitrary preselected axis 88 perpendicular to axis 16 wherein the tipping is controlled to actively force the cup back to a vertical position or other preselected position.

It will be appreciated that in some embodiments the user may grasp the outer walls of the cup directly without the need for a handle 28.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A stabilized cup for individuals with muscular tremors comprising:

a cup body providing a bottom wall and peripheral sidewalls extending upwardly from the bottom wall to an open rim to define a cup volume for receiving liquids through the rim along a cup body axis and holding those liquids when the cup body axis is in an upright orientation;

an electrically powered gyroscope rotor rotatably attached to the cup body to provide gyroscopic stabilization of the cup body; and wherein the electrically powered gyroscope is mounted to rotate about an axis substantially parallel to the cup body axis.

2. The stabilized cup of claim 1 wherein the electrically powered gyroscope is mounted to the cup body below the cup volume.

3. The stabilized cup of claim 2 wherein the stabilized cup further includes a battery communicating with the electrically powered gyroscope rotor for providing power for rotation of the electrically powered gyroscope rotor and wherein the battery is mounted to the cup body below the cup volume.

4. A stabilized cup for individuals with muscular tremors comprising:

a cup body providing a bottom wall and peripheral sidewalls extending upwardly from the bottom wall to an open rim to define a cup volume for receiving liquids through the rim along a cup body axis and holding those liquids when the cup body axis is in an upright orientation;

an electrically powered gyroscope rotor rotatably attached to the cup body to provide gyroscopic stabilization of the cup body;

further including a handle adapted to be grasped by the hand of a user of the stabilized cup while using the stabilized cup; and a movable joint connecting the cup body to the handle to allow pivoting of the handle with respect to the cup body about at least a first axis angled to the cup body axis;

wherein a center of mass of the cup body is below the first axis when the cup body is filled with liquid.

5. The stabilized cup of claim 4 wherein the handle provides first and second spaced apart portions alignable with the cup axis wherein the first portion is adapted to be grasped by the hand of a user and the second portion attaches to the movable joint, wherein the first and second portions are joined at upper edges.

6. The stabilized cup of claim 4 wherein the movable joint swivels about a substantially horizontal axis when the cup axis is vertical.

7. A stabilized cup for individuals with muscular tremors comprising:

a cup body providing a bottom wall and peripheral sidewalls extending upwardly from the bottom wall to an open rim to define a cup volume for receiving liquids through the rim along a cup body axis and holding those liquids when the cup body axis is in an upright orientation;

an electrically powered gyroscope rotor rotatably attached to the cup body to provide gyroscopic stabilization of the cup body;

further including a handle adapted to be grasped by the hand of a user of the stabilized cup while using the stabilized cup;

a movable joint connecting the cup body to the handle to allow pivoting of the handle with respect to the cup body about at least a first axis angled to the cup body axis; and wherein the handle provides a vertical portion to be grasped by the hand of the user so that a proximal/distal axis of the forearm of the hand aligns with the at least one first axis.

8. The stabilized cup of claim 4 further including a lid sealingly fitting over the rim and providing an orifice displaced toward a front of the cup away from the cup body axis and at least one first axis along a direction perpendicular to both the cup vertical axis and at least one first axis.

9. The stabilized cup of claim 4 wherein the movable joint allows the cup body to pivot with respect to the handle about at least two orthogonal axes.

10. The stabilized cup of claim 9 wherein the movable joint allows the cup body to slide with respect to the handle about an axis perpendicular to the at least two orthogonal axes.

11. The stabilized cup of claim 4 wherein the movable joint is selected from the group consisting of a pivoting connection and a flexing connection.

12. The stabilized cup of claim 1 further including an electrical switch controlling power between a battery and the electrically powered gyroscope rotor.

13. The stabilized cup of claim 12 wherein the electrical switch provides an operator exposed for actuation by a user's hand supporting the stabilized cup.

14. The stabilized cup of claim 12 wherein the electrical switch is a momentary contact switch defaulting to an open position.

* * * * *